US009147512B2

(12) United States Patent
Yoo et al.

(10) Patent No.: US 9,147,512 B2
(45) Date of Patent: Sep. 29, 2015

(54) COIL PARTS AND METHOD OF FABRICATING THE SAME

(75) Inventors: Young Seuck Yoo, Seoul (KR); Jeong Bok Kwak, Gyeonggi-do (KR); Yong Suk Kim, Gyeonggi-do (KR); Sang Moon Lee, Seoul (KR); Kang Heon Hur, Gyeonggi-do (KR); Sung Kwon Wi, Seoul (KR)

(73) Assignee: SAMSUNG ELECTRO-MECHANICS CO., LTD., Suwon-si, Gyeonngi-do (KR)

( * ) Notice: Subject to any disclaimer, the term of this patent is extended or adjusted under 35 U.S.C. 154(b) by 0 days.

(21) Appl. No.: 13/413,295

(22) Filed: Mar. 6, 2012

(65) Prior Publication Data

US 2013/0082812 A1 Apr. 4, 2013

(30) Foreign Application Priority Data

Sep. 30, 2011 (KR) ..... 10-2011-0099792

(51) Int. Cl.

| | |
|---|---|
| ***H01F 5/00*** | (2006.01) |
| ***H01F 27/30*** | (2006.01) |
| ***H01F 27/28*** | (2006.01) |
| ***H01F 27/24*** | (2006.01) |
| ***H01F 41/04*** | (2006.01) |

(52) U.S. Cl.

CPC ..... *H01F 5/003* (2013.01); *H01F 41/046* (2013.01); *Y10T 29/49073* (2015.01)

(58) Field of Classification Search

CPC ..... H01F 17/0013; H01F 17/0006; H01F 27/2804; H01F 17/0033; H01L 23/5227

USPC ..... 336/200, 205, 212, 220, 221, 234

See application file for complete search history.

(56) References Cited

U.S. PATENT DOCUMENTS

| | | | | |
|---|---|---|---|---|
| 6,429,764 | B1 * | 8/2002 | Karam et al. | 336/200 |
| 6,498,553 | B1 * | 12/2002 | Tanaka et al. | 336/83 |
| 6,597,270 | B2 * | 7/2003 | Takashima et al. | 336/83 |
| 8,044,758 | B2 * | 10/2011 | Nakamura et al. | 336/200 |
| 2002/0075116 | A1 * | 6/2002 | Peels et al. | 336/200 |
| 2007/0182519 | A1 * | 8/2007 | Tsuzuki et al. | 336/200 |
| 2009/0066300 | A1 * | 3/2009 | Lotfi et al. | 323/247 |

(Continued)

FOREIGN PATENT DOCUMENTS

| | | |
|---|---|---|
| JP | 08-203737 | 8/1996 |
| JP | 2001-076930 A | 3/2001 |

(Continued)

OTHER PUBLICATIONS

Japanese Office Action issued in corresponding Japanese Application No. 2012-035165, dated Dec. 3, 2013.

(Continued)

*Primary Examiner* — Alexander Talpalatski
*Assistant Examiner* — Kazi Hossain
(74) *Attorney, Agent, or Firm* — McDermott Will & Emery LLP

(57) ABSTRACT

A coil part is provided. The coil part includes a coil layer including a core and a first coil and a second coil disposed on and under the core, a lower magnetic layer bonded under the coil layer, and an upper magnetic layer bonded on the coil layer. Accordingly, it is possible to improve process and productivity and cut fabrication costs by preventing process defects that occur during the fabrication process of a coil part using a ferrite substrate.

9 Claims, 6 Drawing Sheets

(56) References Cited

U.S. PATENT DOCUMENTS

| | | | | |
|---|---|---|---|---|
| 2009/0224863 | A1* | 9/2009 | Mano et al. | 336/200 |
| 2009/0243782 | A1* | 10/2009 | Fouquet et al. | 336/200 |

FOREIGN PATENT DOCUMENTS

| | | | | |
|---|---|---|---|---|
| JP | 2006-196812 | | | 7/2006 |
| JP | 2006-196812 | A | | 7/2006 |
| JP | 2006196812 | | * | 7/2006 |
| JP | 2006196812 | A | * | 7/2006 |
| JP | 2006-228983 | A | | 8/2006 |
| JP | 2010-212669 | A | | 9/2010 |
| KR | 10-2002-0077802 | A | | 10/2002 |
| KR | 10-2006-0052814 | | | 5/2006 |
| KR | 10-2007-0032275 | A | | 3/2007 |

OTHER PUBLICATIONS

Korean Office Action dated Aug. 11, 2014 issued in Korean Patent Application No. 10-2011-0099792.

Korean Office Action dated Dec. 23, 2014 issued in Korean Patent Application No. 10-2011-0099792.

* cited by examiner

- PRIOR ART -

300

400

COIL PARTS AND METHOD OF FABRICATING THE SAME

CROSS-REFERENCE TO RELATED APPLICATIONS

This application claims the benefit of Korean Patent Application No. 10-2011-0099792 filed with the Korea Intellectual Property Office on Sep. 30, 2011, the disclosure of which is incorporated herein by reference.

BACKGROUND OF THE INVENTION

1. Field of the Invention

The present invention relates to coil parts, and more particularly, to coil parts and methods of fabricating the same, which can improve process and productivity and cut fabrication costs by preventing process defects that occur during the fabrication process of a coil part using a ferrite substrate.

2. Description of the Related Art

Electronic products, such as digital TVs, smart phones and notebook computers, have functions for data communication in radio-frequency (RF) bands. Such IT electronic products are expected to be more widely used because they have multifunctional and complex features by connecting not only one device but also USBs and other communication ports.

For higher-speed data communication, data are communicated through more internal signal lines over GHz RF channels higher than MHz channels.

When more data are communicated between a main device and a peripheral device over a GHz RF channel, it is difficult to provide smooth data processing due to a signal delay and other noises.

In order to solve the above problem, an electromagnetic interference (EMI) prevention part is provided around the connection between an IT device and a peripheral device. However, conventional EMI prevention parts are used only in limited fields such as large-area substrates because they are coil-type and stack-type and have large chip part sizes and poor electrical characteristics. What is therefore required is EMI prevention parts that are suitable for the slim, miniaturized, complex and multifunctional features of electronic products.

A common-mode filter of a conventional EMI prevention coil part is described below in detail with reference to FIG. 1.

Referring to FIG. 1, a conventional common-mode filter includes a first magnetic substrate 1, a dielectric layer 2 disposed on the magnetic substrate 1 and including a first coil pattern 2*a* and a second coil pattern 2*b* that are vertically symmetrical to each other, and a second magnetic substrate 3 disposed on the dielectric layer 2.

Herein, the dielectric layer 2 including the first coil pattern 2*a* and the second coil pattern 2*b* is formed on the first magnetic substrate 1 through a thin-film process. An example of the thin-film process is disclosed in Japanese Patent Application Laid-Open No. 8-203737.

The second magnetic substrate 3 is bonded to the dielectric layer 2 through an adhesive layer 4.

An external electrode 5 is disposed to surround both ends of a structure including the first magnetic substrate 1, the dielectric layer 2 and the second magnetic substrate 3. The external electrode 5 is electrically connected through a lead line (not shown) to the first coil pattern 2*a* and the second coil pattern 2*b*.

However, in the case of the conventional common-mode filter, in order to provide the dielectric layer 2 having the first coil pattern 2*a* and the second coil pattern 2*b* on the top surface of the first magnetic substrate 1, the top surface of the first magnetic substrate 1 should be accurately processed for a thin-film process.

Also, in order to perform a thin-film process on the top surface of the first magnetic substrate 1, it should be modified into a wafer shape or a shape capable of processes such as photo and deposition, leading to an inefficiency in the fabrication process.

Also, since the first magnetic substrate 1 for the conventional common-mode filter is a hard ferrite substrate, it may be broken and damaged during the fabrication process.

SUMMARY OF THE INVENTION

The present invention has been invented in order to overcome the above-described problems and it is, therefore, an object of the present invention to provide a coil part and a method of fabricating the same, which can improve a fabrication process of the coil part by efficiently performing a fabricating process of a coil layer having a primary coil and a secondary coil and a fabrication process of magnetic layers disposed symmetrically on both sides of the coil layer.

It is another object of the present invention to provide a coil part and a method of fabricating the same which can improve productivity and reduce fabrication costs by preventing process defects that occur when a thin-film process is performed on a ferrite substrate.

In accordance with one aspect of the present invention to achieve the object, there is provided a coil part, which includes: a coil layer including a core and a first coil and a second coil disposed on and under the core; a lower magnetic layer bonded under the coil layer; and an upper magnetic layer bonded on the coil layer.

The core may be formed of at least one of a glass epoxy, a Bismaleimide Triazine (BT) resin, and a polyimide.

The first coil and the second coil may be formed in the shape of a coil by patterning metal layers disposed on and under the core.

The patterning may be performed through a lithography process.

The first coil and the second coil may be patterned simultaneously on both surfaces of the core.

Each of the lower magnetic layer and the upper magnetic layer may be bonded to the coil layer through an adhesive layer.

The adhesive layer may be disposed in the periphery of the coil layer such that a space is formed between the coil layer and the upper magnetic layer and between the coil layer and the lower magnetic layer.

The coil part may further include a central magnetic layer that protrudes from any one of the upper magnetic layer and the lower magnetic layer and pierces the center of the coil layer.

The coil part may further include: a first external extraction electrode disposed at the upper magnetic layer and connected electrically to the first coil; and a second external extraction electrode disposed at the lower magnetic layer and connected electrically to the second coil.

The lower magnetic layer and the upper magnetic layer may be formed in the shape of a sheet including a ferrite.

In accordance with another aspect of the present invention to achieve the object, there is provided a coil part, which includes: a first coil layer including a first core and a first upper coil and a first lower coil disposed on and under the first core; a second coil layer corresponding to the first coil layer and including a second core and a second upper coil and a second lower coil disposed on and under the second core; a first magnetic layer bonded to the first coil layer; and a second magnetic layer bonded to the second coil layer.

The first core and the second core may be formed of at least one of a glass epoxy, a Bismaleimide Triazine (BT) resin, and a polyimide.

The first upper coil and the first lower coil may be formed in the shape of a coil by patterning metal layers disposed on and under the first core, and the second upper coil and the second lower coil may be formed in the shape of a coil by patterning metal layers disposed on and under the second core.

The patterning may be performed through a lithography process.

The first upper coil and the first lower coil may be patterned simultaneously on both surfaces of the first core, and the second upper coil and the second lower coil may be patterned simultaneously on both surfaces of the second core.

The first magnetic layer and the second magnetic layer may be bonded respectively to the first coil layer and the second coil layer through an adhesive layer.

The first magnetic layer and the second magnetic layer may be formed in the shape of a sheet including a ferrite.

The first upper coil and the first lower coil of the first coil layer may be electrically connected through a first conductive via piercing the first core, and the second upper coil and the second lower coil of the second coil layer may be electrically connected through a second conductive via piercing the second core.

The first conductive via may include a first via hole piercing the first core, and a first plating layer disposed in the first via hole such that the first upper coil side and the first lower coil side are formed to be symmetrical to each other; and the second conductive via may include a second via hole piercing the second core, and a second plating layer disposed in the second via hole such that the second upper coil side and the second lower coil side are formed to be symmetrical to each other.

In accordance with another aspect of the present invention to achieve the object, there is provided a method of fabricating a coil part that includes a coil layer and an upper magnetic layer and a lower magnetic layer bonded respectively on and under the coil layer, which includes: forming a coil layer by forming an upper coil and a lower coil on and under a core; and bonding an upper magnetic layer and a lower magnetic layer on and under the coil layer.

The forming of the coil layer may include: forming metal layers on and under a core; and patterning the metal layers to form a first coil and a second coil.

The patterning may be performed simultaneously on both surfaces of the core through a lithography process.

The upper magnetic layer and the lower magnetic layer may be bonded to the coil layer through an adhesive layer.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERABLE EMBODIMENTS

Figure 1:
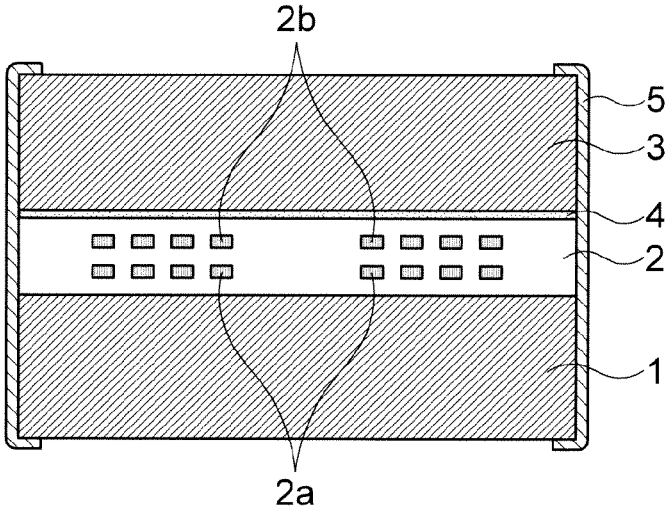
FIG. 1 is a cross-sectional view of a common-mode filter of a conventional coil part.

Exemplary embodiments of the present invention will be described below in detail with reference to the accompanying drawings. Advantages and features of the inventive concept, and implementation methods thereof will be clarified through the following embodiments described with reference to the accompanying drawings. The inventive concept may, however, be embodied in different forms and should not be construed as limited to the embodiments set forth herein. Rather, these embodiments are provided so that this disclosure will be thorough and complete, and will fully convey the scope of the inventive concept to those skilled in the art. Like reference numerals denote like elements throughout the specification and drawings.

The terms used herein are for the purpose of describing the exemplary embodiments only and are not intended to limit the scope of the present invention. As used herein, the singular forms 'a', 'an', and 'the' are intended to include the plural forms as well, unless the context clearly indicates otherwise. It will also be understood that the terms 'comprise', 'include' and 'have' used herein specify the presence of stated components, steps, operations, and/or elements, but do not preclude the presence or addition of one or more other components, steps, operations, and/or elements.

The embodiments of the present invention will be described with reference to cross-sectional views or plan views as ideal exemplary views of the present invention. In the drawings, the thicknesses or dimensions of layers and regions are exaggerated for effective description of technical features. Accordingly, shapes of the exemplary views may be modified according to manufacturing techniques and/or allowances. Therefore, the embodiments of the present invention are not limited to the specific shapes illustrated in the exemplary views, but may include other shapes that may be created according to manufacturing processes. For example, an etched region illustrated as a rectangle may have rounded or curved features. Thus, the regions illustrated in the drawings are schematic in nature, and their shapes are intended to exemplify the specific shapes of the regions of a device and are not intended to limit the scope of the present invention.

Coil parts and fabricating methods thereof in accordance with embodiments of the present invention will be described below in detail with reference to FIGS. 2 to 8.

Figure 2:
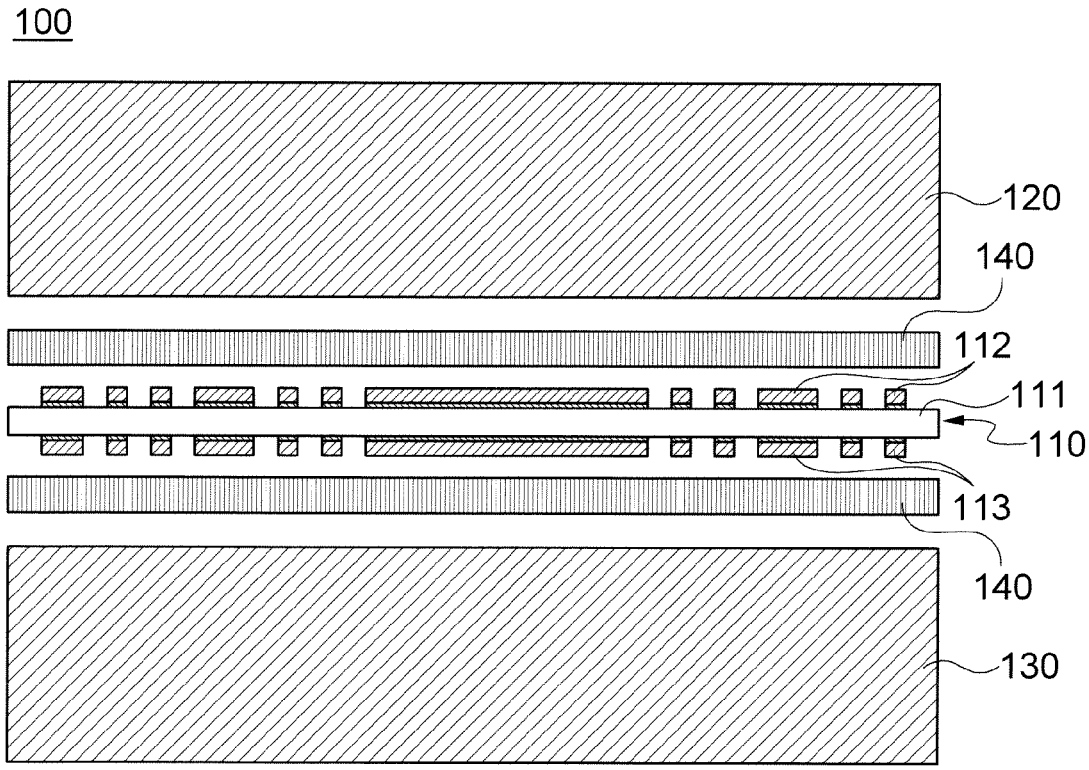
FIG. 2 is a cross-sectional view of a coil part in accordance with a first embodiment of the present invention.
Figure 4:
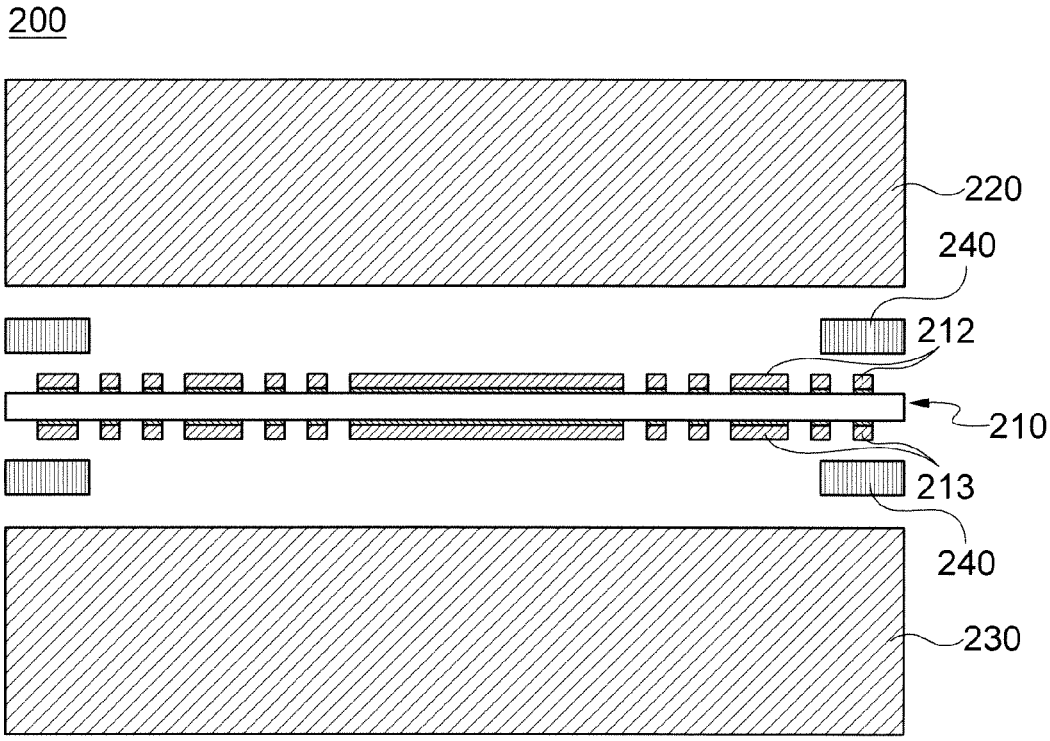
FIG. 4 is a cross-sectional view of a coil part in accordance with a second embodiment of the present invention.
Figure 5:
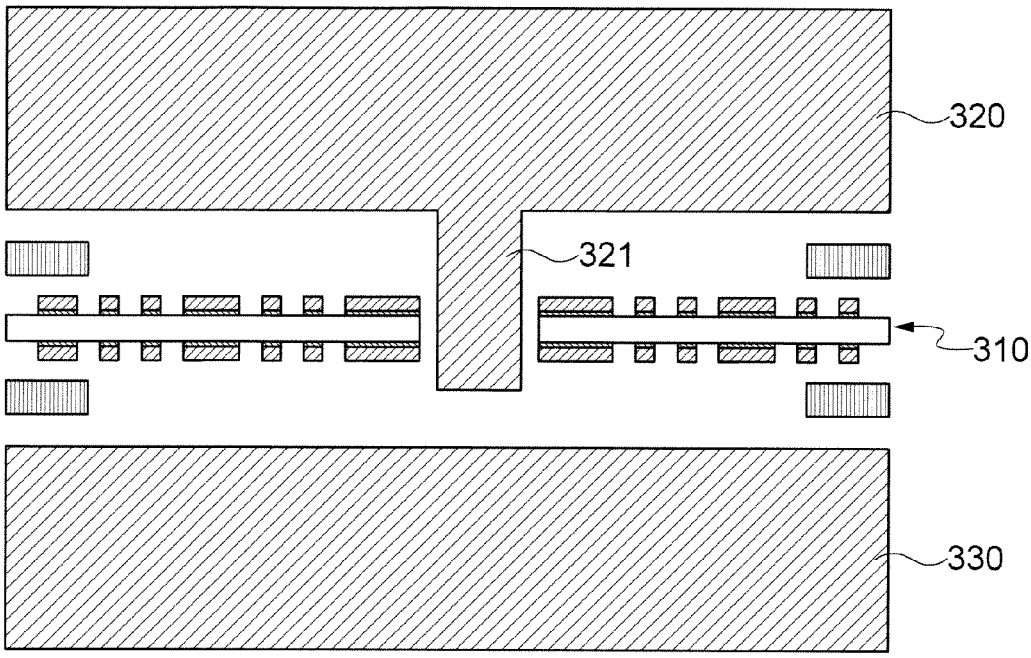
FIG. 5 is a cross-sectional view of a coil part in accordance with a third embodiment of the present invention.
Figure 6:
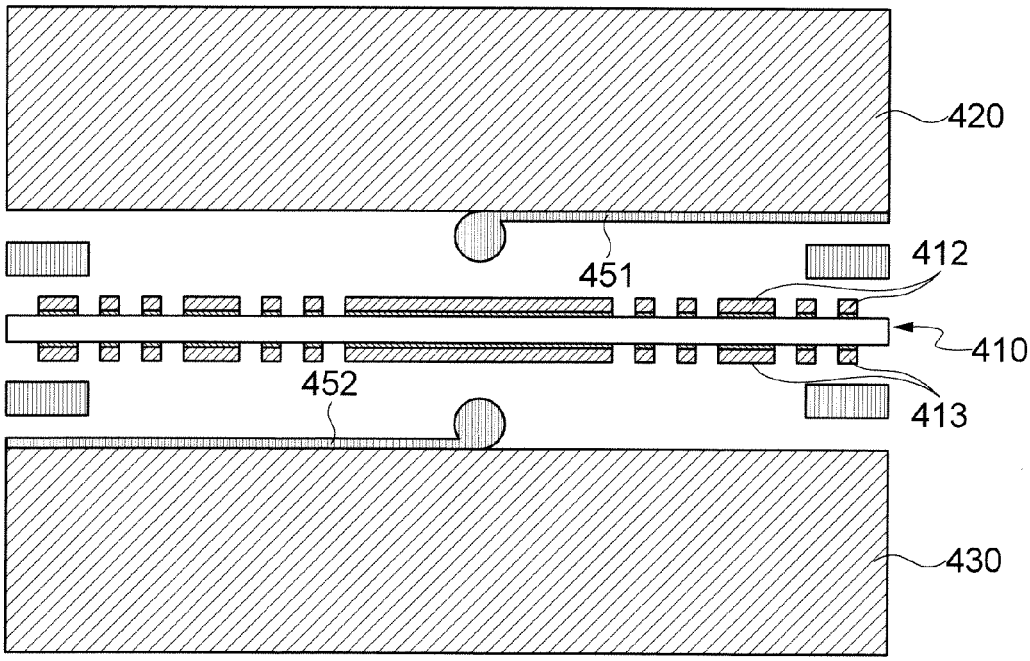
FIG. 6 is a cross-sectional view of a coil part in accordance with a fourth embodiment of the present invention.
Figure 7:
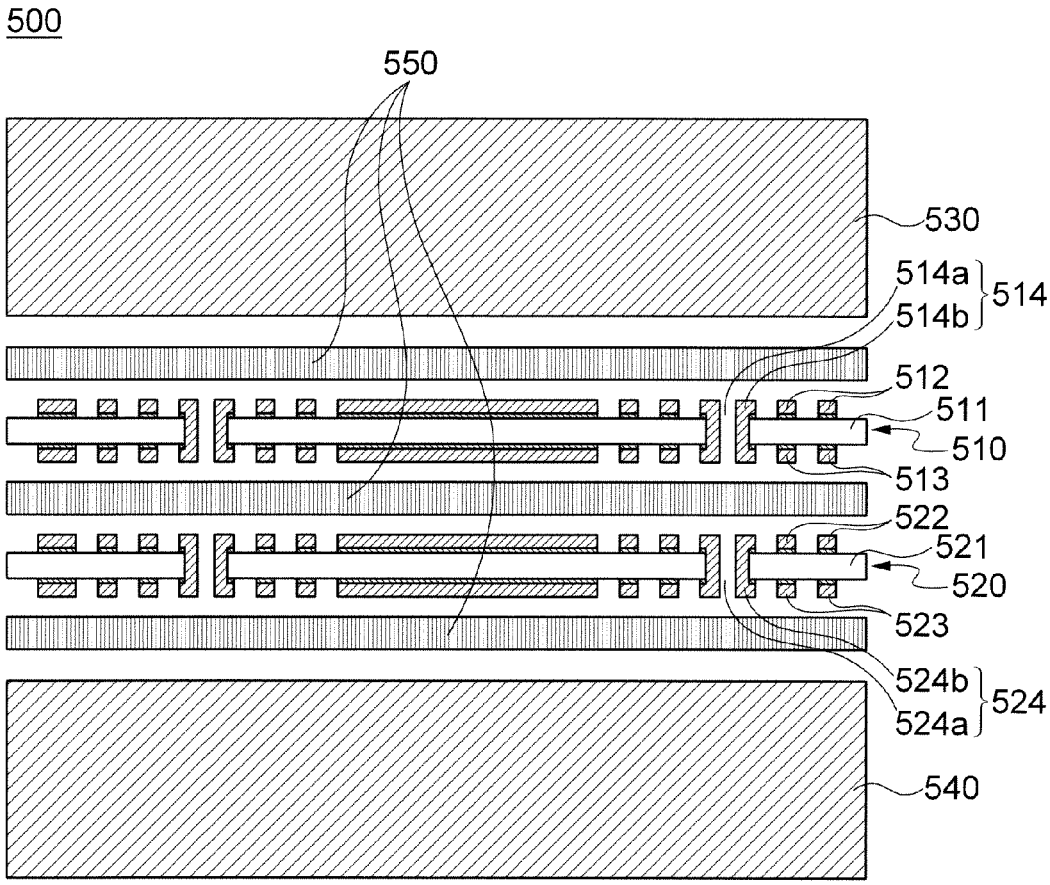
FIG. 7 is a cross-sectional view of a coil part in accordance with a fifth embodiment of the present invention.

FIG. 2 is a cross-sectional view of a coil part in accordance with a first embodiment of the present invention. FIGS. 3A to 3G are cross-sectional views showing a method of fabricating a coil layer of FIG. 2. FIG. 4 is a cross-sectional view of a coil part in accordance with a second embodiment of the present invention. FIG. 5 is a cross-sectional view of a coil part in accordance with a third embodiment of the present invention. FIG. 6 is a cross-sectional view of a coil part in accordance with a fourth embodiment of the present invention. FIG. 7 is a cross-sectional view of a coil part in accordance with a fifth embodiment of the present invention. FIGS. 8A to 8H are cross-sectional views showing a method of fabricating a first coil layer of FIG. 7.

A coil part and a fabricating method thereof in accordance with a first embodiment of the present invention will be described below in detail with reference to FIGS. 2 and 3A to 3G.

Referring to FIG. 2, a coil part 100 in accordance with a first embodiment of the present invention includes a coil layer 110, an upper magnetic layer 120 bonded on the coil layer 110, and a lower magnetic layer 130 bonded under the coil layer 120.

The coil layer 110 may include a core 111 and a first coil 112 and a second coil 113 disposed on and under the core 111.

Herein, the core 111 may be formed of at least one of a glass epoxy, a Bismaleimide Triazine (BT) resin, and a polyimide, to which the present invention is not limited.

The first coil 112 and the second coil 113 may be formed in the shape of a coil by patterning metal layers disposed on and under the core 111.

Herein, the patterning may be performed through a lithography process.

The first coil 112 and the second coil 113 may be patterned simultaneously on both surfaces of the core 111.

A method of fabricating the coil layer 110 in accordance with this embodiment will be described below in detail with reference to FIGS. 3A to 3G.

Figure 3A:
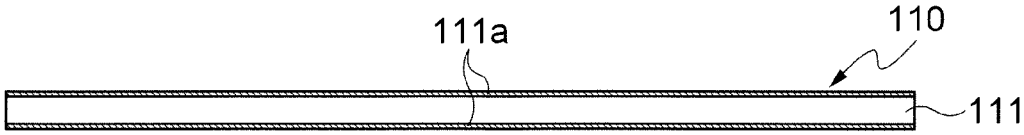
FIGS. 3A to 3G are cross-sectional views showing a method of fabricating a coil layer of FIG. 2.

As shown in FIG. 3A, a core 111 having a copper foil 111*a* laminated on top and bottom surfaces thereof, that is, a copper clad laminate (CCL) is prepared.

Figure 3B:
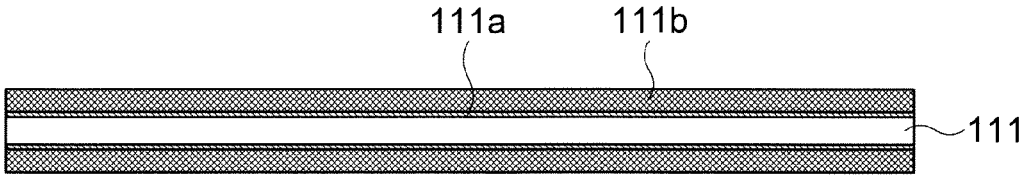

As shown in FIG. 3B, the top and bottom surfaces of the core 111 are coated with a photoresist (PR) layer 111*b* formed of a photosensitive material for photolithography, such as a dry film.

Figure 3C:
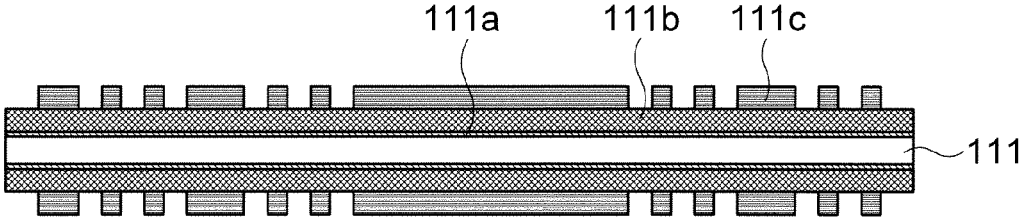

As shown in FIG. 3C, an exposure process is performed on both surfaces of the core 111 with an exposure mask 111*c* disposed on the PR layer 111*b*.

Figure 3D:
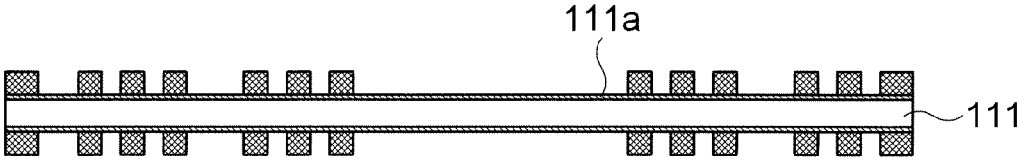

As shown in FIG. 3D, a development process is performed on the core 111 to pattern a circuit pattern corresponding to a coil pattern on the PR layer 111*b*.

Figure 3E:
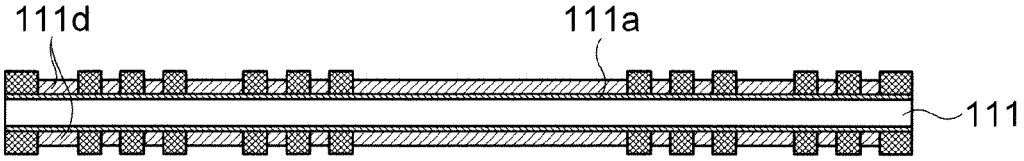

As shown in FIG. 3E, a conductive metal material 111*d* is deposited on the patterned region, like Cu plating.

Herein, a metal pattern formed on one of the top and bottom surfaces of the core 111 may form a first coil 112, and a metal pattern formed on the other surface may form a second coil 113.

Figure 3F:
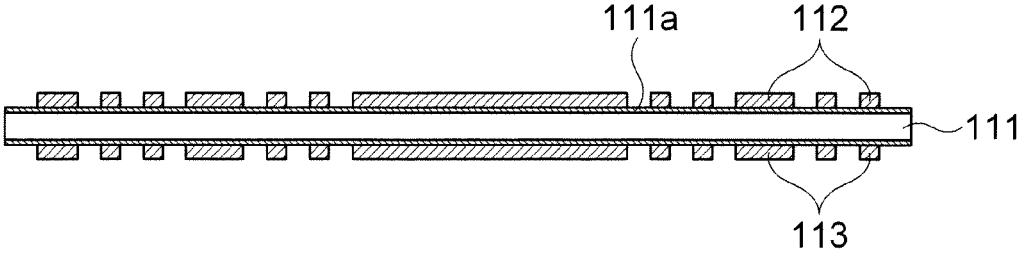

As shown in FIG. 3F, the PR layer 111*b* is removed.

Figure 3G:
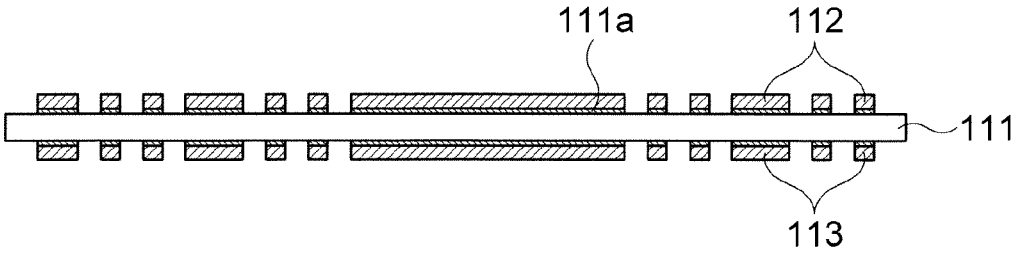

As shown in FIG. 3G, an etching process is performed on both surfaces of the core 111 to etch an unnecessary portion the copper foil 111*a* formed on both surfaces of the core 111 (i.e., a seed layer), thereby completing the fabrication of the coil layer 110 including the core 111 and the first coil 112 and the second coil 113 formed on the top and bottom surfaces of the core 111.

The upper magnetic layer 120 and the lower magnetic layer 130 may be bonded respectively to the top and bottom surfaces of the coil layer 110 through an adhesive layer 140.

The upper magnetic layer 120 and the lower magnetic layer 130 may be formed in the shape of a sheet including a ferrite.

A coil part in accordance with a second embodiment of the present invention will be described below in detail with reference to FIG. 4.

As shown in FIG. 4, a coil part 200 in accordance with this embodiment is different from the coil part 100 of the first embodiment in terms of the structure of an adhesive layer 240.

Specifically, in this embodiment, an adhesive layer 240, used to bond an upper magnetic layer 220 and a lower magnetic layer 230 to a coil layer 210, may be disposed only in the periphery of the coil layer 210 such that a space is formed between the coil layer 210 and the upper magnetic layer 220 and between the coil layer 210 and the lower magnetic layer 230.

Thus, the coil layer 210 forms a space around a first coil 212 and a second coil 213 to maintain a dielectric constant of the periphery of the coil layer 210 to be '1', thereby making it possible to improve the filtering characteristics to approach the filtering characteristics of a winding-type coil part.

Except for the structure of the adhesive layer 240, the coil part 200 of this embodiment has the same structure as the coil part 100 of the first embodiment. Thus, a detailed description of a fabrication method for the coil part 200 will be omitted for conciseness.

A coil part in accordance with a third embodiment of the present invention will be described below in detail with reference to FIG. 5.

As shown in FIG. 5, a coil part 300 in accordance with this embodiment is different from the coil part 200 of the second embodiment in terms of the structure of an upper magnetic layer 320.

Specifically, the coil part 300 of this embodiment further includes a central magnetic layer 321 extending from an upper magnetic layer 320, among the upper magnetic layer 320 and a lower magnetic layer 330 bonded on and under a coil layer 310.

That is, the central magnetic layer 321 protrudes from the upper magnetic layer 320 and pierces the center of the coil layer 310. Accordingly, the filtering characteristics of the coil part can be improved because a magnetic material passes through the center of the coil layer 310.

In another embodiment, the central magnetic layer 321 may protrude from the lower magnetic layer 330.

Except for the structure of the central magnetic layer 321, the coil part 300 of this embodiment has the same structure as the coil part 200 of the second embodiment. Thus, a detailed description of a fabrication method for the coil part 300 will be omitted for conciseness.

A coil part in accordance with a fourth embodiment of the present invention will be described below in detail with reference to FIG. 6.

As shown in FIG. 6, a coil part 400 in accordance with this embodiment is different from the coil part 200 of the second embodiment in terms of the structure of a first external extraction electrode 451 connected electrically to a first coil 412 and the structure of a second external extraction electrode 452 connected electrically to a second coil 413.

Although not shown in the drawings, while the coil part 200 of the second embodiment leads out an extraction electrode from a coil layer when connecting the first coil and the second coil to an external electrode, the coil part 400 of this embodiment has the first external extraction electrode 451 (connecting the first coil 412 to an external electrode) at the bonding surface of an upper magnetic layer 420, and has the second external extraction electrode 452 (connecting the second coil 413 to an external electrode) at the bonding surface of a lower magnetic layer 430.

Accordingly, since the coil part 400 of this embodiment can provide not only the bonding between the coil layer 410 and the upper/lower magnetic layer 420/430 but also additional electrical connection therebetween, it can implement an additional circuit function and improve electrical connection and reliability.

Except for the structure of the external extraction electrodes 451 and 452, the coil part 400 of this embodiment has the same structure as the coil part 200 of the second embodiment. Thus, a detailed description of a fabrication method for the coil part 300 will be omitted for conciseness.

A coil part in accordance with a fifth embodiment of the present invention will be described below in detail with reference to FIGS. 7 and 8A to 8H.

Referring to FIG. 7, a coil part 500 in accordance with a fifth embodiment of the present invention includes a first coil layer 510, a second coil layer 520 corresponding to the first coil layer 510; a first magnetic layer 530 bonded to the first coil layer 510, and a second magnetic layer 540 bonded to the second coil layer 520.

The first coil layer 510 may include a first core 511 and a first upper coil 512 and a first lower coil 513 disposed on and under the first core 511.

Likewise, the second coil layer 520 may include a second core 521 and a second upper coil 522 and a second lower coil 523 disposed on and under the second core 521.

Herein, the first core 511 and the second core 521 may be formed of at least one of a glass epoxy, a Bismaleimide Triazine (BT) resin, and a polyimide, to which the present invention is not limited.

The first upper coil 512 and the first lower coil 513 may be formed in the shape of a coil by patterning metal layers disposed on and under the first core 511.

Likewise, the second upper coil 522 and the second lower coil 523 are formed in the shape of a coil by patterning metal layers disposed on and under the second core 521.

Herein, the patterning may be performed through a lithography process.

The first upper coil 512 and the first lower coil 513 may be patterned simultaneously on both surfaces of the first core 511, and the second upper coil 522 and the second lower coil 523 may be patterned simultaneously on both surfaces of the second core 521.

The first upper coil 512 and the first lower coil 513 of the first coil layer 510 may be electrically connected through a first conductive via 514 piercing the first core 511.

Likewise, the second upper coil 522 and the second lower coil 523 of the second coil layer 520 may be electrically connected through a second conductive via 524 piercing the second core 521.

Herein, the first conductive via 514 may include a first via hole 514*a* piercing the first core 511, and a first plating layer 514*b* disposed in the first via hole 514*a* such that the first upper coil 512 and the first lower coil 513 are formed to be symmetrical to each other.

Likewise, the second conductive via 524 may include a second via hole 524*a* piercing the second core, and a second plating layer 524*b* disposed in the second via hole 524*a* such that the second upper coil 522 and the second lower coil 523 are formed to be symmetrical to each other.

A method of fabricating the first coil layer 510 in accordance with this embodiment will be described below in detail with reference to FIGS. 8A to 8H. A fabrication method of the second coil layer 520 is the same as the fabrication method of the first coil layer 510, and a duplicate description thereof will be omitted for conciseness.

Figure 8A:
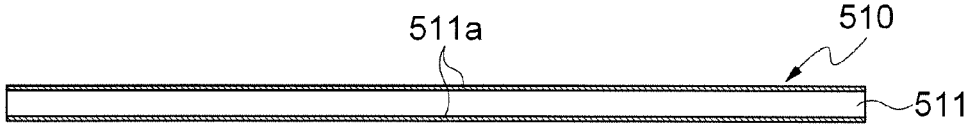
FIGS. 8A to 8H are cross-sectional views showing a method of fabricating a first coil layer of FIG. 7.

As shown in FIG. 8A, a first core 511 having a copper foil 511*a* laminated on top and bottom surfaces thereof, that is, a copper clad laminate (CCL) is prepared.

Figure 8B:
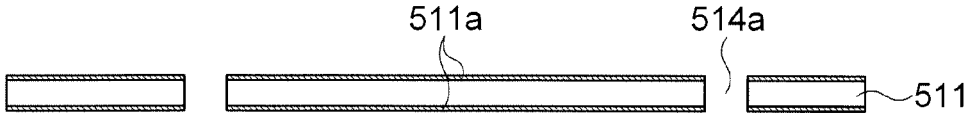

As shown in FIG. 8B, for connection between a first upper coil and a first lower coil to be formed later, a mechanical process such as a drilling process is performed to puncture a first via hole 514*a* in the first core 511 laminated with the copper foil 511*a*.

Figure 8C:
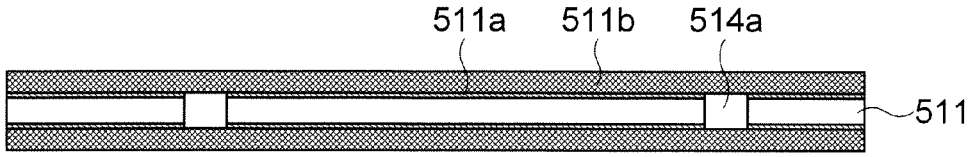

As shown in FIG. 8C, the top and bottom surfaces of the first core 511 are coated with a photoresist (PR) layer 511*b* formed of a photosensitive material for photolithography, such as a dry film.

Figure 8D:
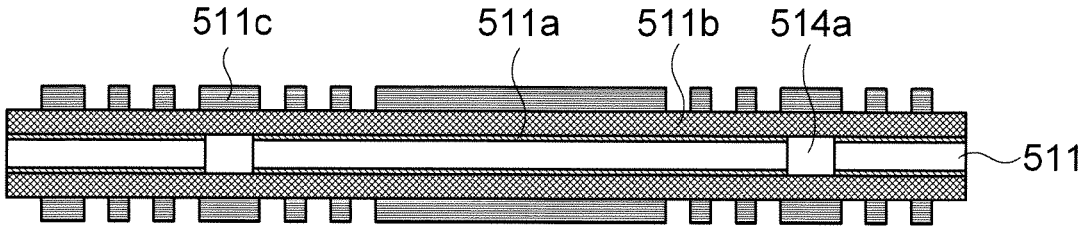

As shown in FIG. 8D, an exposure process is performed on both surfaces of the first core 511 with an exposure mask 511*c* disposed on the PR layer 511*b*.

Figure 8E:
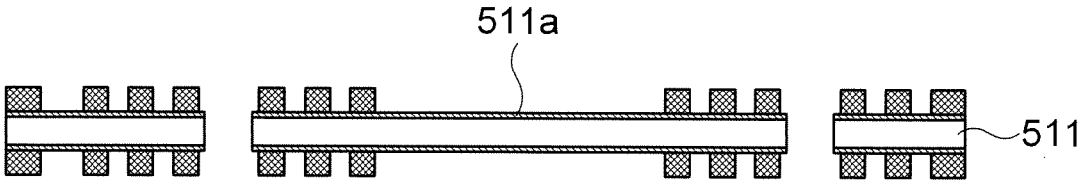

As shown in FIG. 8E, a development process is performed on the first core 511 to pattern a circuit pattern corresponding to a coil pattern on the PR layer 511*b*.

Figure 8F:
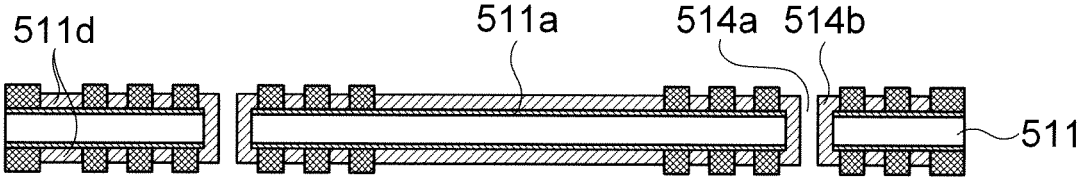

As shown in FIG. 8F, a conductive metal material 511*d* is deposited on the patterned region, like Cu plating.

Herein, a conductive material may also be plated to form a first plating layer 514*b* in the first via hole 514*a*.

Figure 8G:
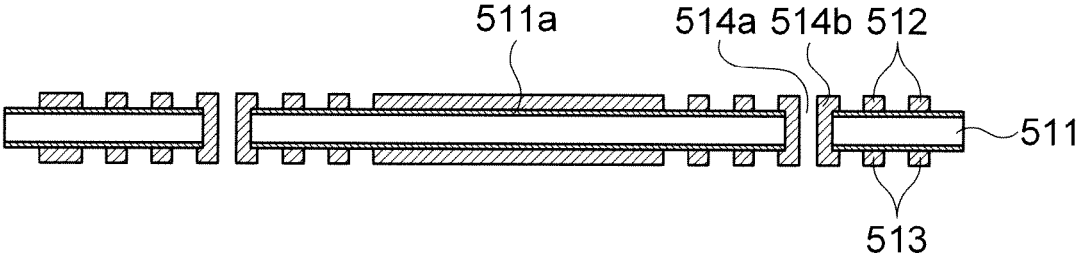

As shown in FIG. 8G, the PR layer 511*b* is removed.

Figure 8H:
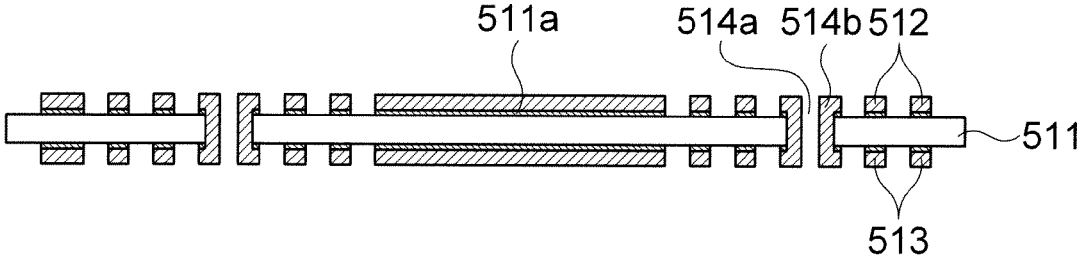

As shown in FIG. 8H, an etching process is performed on both surfaces of the first core 511 to etch an unnecessary portion the copper foil 511*a* formed on both surfaces of the first core 511 (i.e., a seed layer), thereby completing the fabrication of the coil layer 510 including the first core 511 and the first upper coil 512 and the first lower coil 513 formed on the top and bottom surfaces of the first core 511.

The first plating layer 514*b* for inter-layer electrical connection may be formed in the first via hole 514*a*. Accordingly, the first conductive via 514 including the first plating layer 514*b* may be formed to be vertically symmetrical. The metal patterns formed on and under the first core 511 through the first conductive via 514 may be electrically connected to form a primary coil.

That is, the first upper coil 512 and the first lower coil 513 connected electrically through the first conductive via 514 may form a primary coil pattern of the coil part, and the second upper coil 522 and the second lower coil 523 connected electrically through the second conductive via 524 may form a secondary coil pattern of the coil part.

The first magnetic layer 530 and the second magnetic layer 540 may be bonded respectively to the first coil layer 510 and the second coil layer 520 through an adhesive layer 550.

The first magnetic layer 530 and the second magnetic layer 540 may be formed in the shape of a sheet including a ferrite.

As described above, according to the coil parts and the fabricating methods thereof, it is possible to improve the fabrication process by fabricating a coil layer through a separate process and bonding magnetic layers onto the coil layer in a simplified manner.

Also, according to the coil parts and the fabricating methods thereof, it is possible to improve productivity and cut fabrication costs by preventing process defects such as a damage to a ferrite substrate that occur when a thin-film process is performed on the ferrite substrate.

Although the preferable embodiments of the present invention have been shown and described above, it will be appreciated by those skilled in the art that substitutions, modifications and variations may be made in these embodiments without departing from the principles and spirit of the general inventive concept, the scope of which is defined in the appended claims and their equivalents.

What is claimed is:

1. A coil part, which comprises:

a coil layer including a core and a first coil and a second coil disposed on and under the core;

a lower magnetic layer bonded under the coil layer;

an upper magnetic layer bonded on the coil layer;

a first external extraction electrode directly contacting the upper magnetic layer and having a prominence region connecting an end portion thereof to the first coil, wherein the prominence region of the first external extraction electrode is projecting in a space between the core and the upper magnetic layer; and a second external extraction electrode directly contacting the lower magnetic layer and having a prominence region connecting an end portion thereof to the second coil, wherein the prominence region of the second external extraction electrode is projecting in a space between the core and the lower magnetic layer.

2. The coil part according to claim 1, wherein the core is formed of at least one of a glass epoxy, a Bismaleimide Triazine (BT) resin, and a polyimide.

3. The coil part according to claim 1, wherein the first coil and the second coil are formed in the shape of a coil by patterning metal layers disposed on and under the core.

4. The coil part according to claim 3, wherein the patterning is performed through a lithography process.

5. The coil part according to claim 3, wherein the first coil and the second coil are patterned simultaneously on both surfaces of the core.

6. The coil part according to claim 1, wherein each of the lower magnetic layer and the upper magnetic layer is bonded to the coil layer through an adhesive layer.

7. The coil part according to claim 6, wherein the adhesive layer is disposed in the periphery of the coil layer such that a space is formed between the coil layer and the upper magnetic layer and between the coil layer and the lower magnetic layer.

8. The coil part according to claim 1, which further comprises a central magnetic layer that protrudes from any one of the upper magnetic layer and the lower magnetic layer and pierces the center of the coil layer.

9. The coil part according to claim 1, wherein the lower magnetic layer and the upper magnetic layer are formed in the shape of a sheet including a ferrite.

* * * * *